US005431366A

United States Patent [19]

Matsumoto et al.

[11] Patent Number: 5,431,366

[45] Date of Patent: Jul. 11, 1995

[54] SEE-THROUGH CONCRETE FORM

[75] Inventors: Masahito Matsumoto, Ibaraki; Takeo Kitayama, Takatsuki; Shigeyoshi Matubara, Osaka, all of Japan

[73] Assignee: Sumitomo Chemical Company, Limited, Osaka, Japan

[21] Appl. No.: 234,354

[22] Filed: Apr. 28, 1994

[30] Foreign Application Priority Data

Apr. 28, 1993 [JP] Japan ..... 5-102630

[51] Int. Cl.[6] ..... E04G 9/05

[52] U.S. Cl. ..... 249/13; 249/135; 249/189; 249/210

[58] Field of Search ..... 249/112, 113, 114.1, 249/115, 116, 134, 135, 189, 210, 13

[56] References Cited

U.S. PATENT DOCUMENTS 3,891,179 6/1975 Berman .
4,210,304 7/1980 Mannina ..... 249/22
5,183,095 2/1993 Sullivan ..... 249/54

FOREIGN PATENT DOCUMENTS 2905609 8/1980 Germany .
6480665 9/1987 Japan .
194159 10/1987 Japan .
9409227 4/1994 Japan .

OTHER PUBLICATIONS

Derwent Publications Ltd., London, GB; AN 93-239498.
Derwent Publications Ltd., JP-A-5 162 111, Jun. 1993.

*Primary Examiner*—Khanh Nguyen
*Attorney, Agent, or Firm*—Cushman Darby & Cushman

[57] ABSTRACT

A concrete form a part of which is made of a fiber-reinforced thermoplastic resin, said fiber-reinforced thermoplastic resin satisfying the following conditions:

$$Tt(C) \geqq Tt(M) - 1.5\alpha$$

$$15 \leqq Tt(c)$$

wherein Tt(C) (%) is total transmittance of the fiber-reinforced thermoplastic resin measured at the thickness of top board, $\alpha$ (% by weight) is fiber weight fraction of the fiber-reinforced thermoplastic resin, and Tt(M) (%) is total transmittance of the matrix resin measured at the same thickness as above.

20 Claims, 1 Drawing Sheet

SEE-THROUGH CONCRETE FORM

BACKGROUND OF THE INVENTION

1. Field of the Invention

The present invention relates to a see-through concrete form through which the state of concrete packed in the concrete form can be inspected at the time of concrete placement.

2. Related Art Statement

Conventionally, concrete forms made of woody materials such as southern sea's timber and the like have been used. When concrete is placed in such concrete forms having no see-through property, however, the state of concrete packed in the form cannot be inspected visually. Thus, when the concrete packed in a form is defective, such as having a gap between the form and concrete, it has been sometimes necessary to destroy the produced construction after the concrete placement, and to place the concrete once again.

For such a reason, the use of a transparent synthetic resin board as a concrete form has been proposed (Japanese Patent Application KOKAI No. 64-80665, No. 1-94159, etc.). However, this transparent synthetic resin board is inferior in stiffness and impact strength, and can exhibit a sufficient strength for use as a concrete form only when an additional measure, such as increasing the thickness of the top, bonding a crosspiece, etc. is taken.

OBJECT AND SUMMARY OF THE INVENTION

In view of above, the present inventors conducted studies with the aim of developing a concrete form having excellent strength and a transparency that enables a visual inspection of the state of concrete packed in the form. Based on the studies, the present invention was accomplished.

The present invention provides a concrete form having at least a portion thereof made of a fiber-reinforced thermoplastic resin. The fiber-reinforced thermoplastic resin satisfying the following conditions:

$$Tt(C) \geqq Tt(M) - 1.5\alpha$$

$$15 \leqq Tt(C)$$

wherein Tt(C) (%) is total transmittance of the fiber-reinforced thermoplastic resin measured at the thickness of top board, $\alpha$ (% by weight) is fiber weight fraction in the fiber-reinforced thermoplastic resin, and Tt(M) (%) is total transmittance of the matrix resin measured at the same thickness as above.

DETAILED DESCRIPTION OF THE INVENTION

Figure 1:
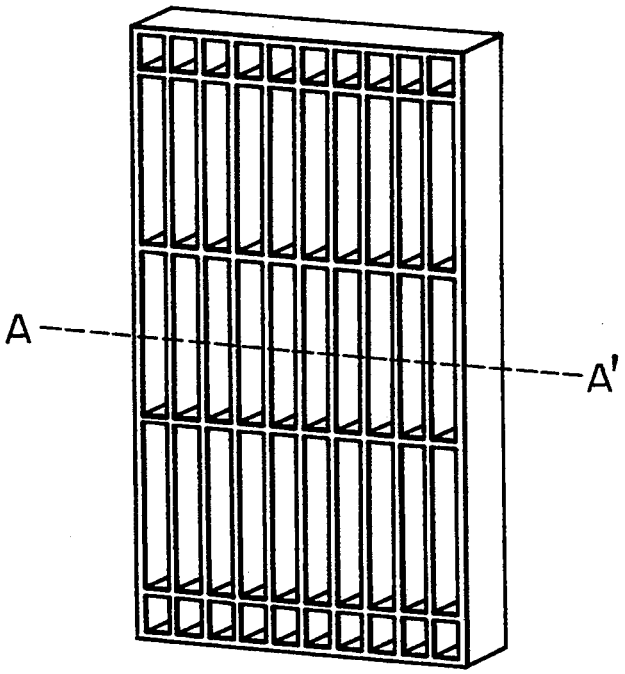
FIG. 1 illustrates one embodiment of the present concrete form having a number of ribs on the backside from the rib side.

A concrete form is required to have high stiffness and high impact strength. In the case of resin-made concrete form, a higher fiber weight fraction in the used fiber-reinforced resin gives a higher strength and a lower see-through property. At a fixed fiber weight fraction, a higher total transmittance of the matrix resin gives the fiber-reinforced resin a better see-through property.

In order to exhibit a good see-through property while retaining a high strength as a concrete form, a fiber-reinforced resin must have a total transmittance not smaller than a certain standard value. When thickness of a fiber-reinforced resin is fixed, total transmittance of resin board Tt(C) is dependent on the fiber weight fraction $\alpha$ (% by weight) and the total transmittance of matrix resin Tt(M) (%), and a sufficient see-through property can be exhibited when the following conditions are satisfied, as has been mentioned above:

$$Tt(C) \geqq Tt(M) - 1.5\alpha$$

$$15 \leqq Tt(C)$$

When total transmittance of the fiber-reinforced resin does not satisfy the above conditions, the total transmittance markedly decreases as the fiber weight fraction increases, as a result of which no sufficient see-through property can be achieved when such a fiber-reinforced resin is made into a concrete form having a necessary strength.

The thermoplastic resin used as a base material for the concrete form of the invention is not critical, so far as the resin has a strength enough to be usable as a concrete form. Thermoplastic resins such as polyethylene, polypropylene, ABS resin, vinyl chloride resin, PMMA, nylon, polycarbonate resin and the like can be used for this purpose. Among these resins, polypropylene is preferred from the viewpoint of heat resistance, strength and economy.

As the reinforcing fiber, glass fiber is preferred, though other fibers such as alumina fiber and the like are also usable without limitation.

The fiber weight fraction may be any value, so long as it is in the range defined above. From the viewpoint of strength and economy, however, the fiber weight fraction is usually from 10 to 50% by weight, and preferably from 15 to 30% by weight.

When glass fiber is used, the fiber length is usually from 0.1 to 50 mm, and preferably from 1 to 15 mm. The fiber diameter is usually from 1 to 50 $\mu$m.

A binder may be incorporated into the present fiber-reinforced resin for the purpose of improving the adhesiveness between fiber and resin, so long as the total transmittance satisfies the above-mentioned conditions.

Needless to say, other compounding additives conventionally added to thermoplastic resins, such as stabilizers, colorants, fillers and the like, may also be incorporated into the fiber-reinforced resin, so long as total transmittance satisfies the above-mentioned conditions.

The structure of the concrete form of the present invention, made of a thermoplastic resin, is not critical. It may be a flat board composed of top board 6 only, or the top board may have a number of ribs 7 on backside to form a comb-like section.

The process for producing the concrete form of the present invention is not particularly limited, but conventional resin forming processes such as injection molding process, injection-compression molding process, and the like can be adopted.

In the concrete form of the present invention, the overall thickness of the form is not critical, so far as it is such a thickness as to give a necessary strength. Usually, the overall thickness is from about 10 mm to about 70 mm. Preferably, the overall thickness is from 10 mm to 15 mm in the case of flat board and from 62 mm to 65 mm in the case of rib-like structure, from the viewpoint of workability at the time of use and particularly in view of the relation to the so far widely used woody concrete form.

When concrete is placed by the use of the see-through concrete form of the present invention, there can be achieved an effect that the state of concrete packed in the form, such as presence or absence of gap and the like, can be inspected visually.

PREFERRED EMBODIMENTS OF THE INVENTION

The invention will be illustrated in more detail with reference to the following examples. Needless to say, the present invention is by no means limited by these examples.

The testing methods used in the examples were as follows.

Total transmittance: This was measured according to JIS K7150-Revision, Method B. The apparatus used for the measurement was Integral Cube Type Reflecting Transmission Meter (Model RT-100, manufactured by Zaiko Shikisai Gijutsu Kenkyusho K. K.).

Bending test: This was measured according to eight points support method of JIS K7203.

Figure 2:
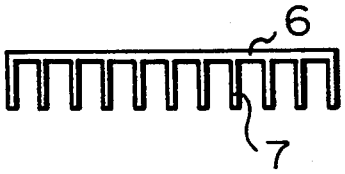
FIG. 2 illustrates a sectional view of the concrete form taken through the line A–A' in FIG. 1, wherein reference numeral 6 refers to a top board, and reference numeral 7 refers to ribs.
Figure 3:
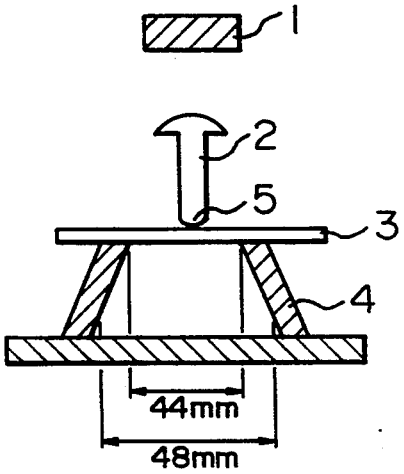
FIG. 3 illustrates the apparatus used for impact test of the concrete form according to one embodiment of the invention, wherein: reference numeral 1 refers to a load, reference numeral 2 refers to a point of impact, reference numeral 3 refers to a test piece (top board), reference numeral 4 refers to a bearer for test piece, and reference numeral 5 refers to a tip of the point of impact.

Impact strength: The apparatus shown in FIG. 2 was used. An impact point having a ½ inch semi-circular tip was placed on test piece having a size of 50 mm×50 mm, and a load was let fall down thereon from upside. The minimum fall distance required for breakage of test piece (breaking height) was measured under a load, from which breaking energy was calculated according to the following equation, and the breaking energy was taken as "impact strength":

$$\text{Breaking energy (kg.cm)} = \text{Load (kg)} \times \text{Breaking height (cm)}$$

EXAMPLES 1 AND 2

A polypropylene pellet (matrix resin; AX574, manufactured by Sumitomo Chemical Co., Ltd.; MI=45) containing a glass fiber (fiber length 6 mm, fiber diameter 13 μm) was fed into a plasticizing apparatus, and melted at 230° C. The melted fiber-reinforced resin was fed into the cavity between the dies of a male-female fitting type press through a melted resin feeding path provided in the female die while keeping the cavity clearance at about 10 mm. Then, the dies were clamped until the cavity clearance reached 2.5 mm, after which the dies were pressed and cooled to obtain a concrete of rib-like structure having a width of 600 mm, a height of 900 mm and a thickness of 61.0 mm, as shown in FIG. 1. Dimensions of the concrete form thus obtained were as follows:

Thickness of top board: 2.5 mm
Height of rib: 58.5 mm
Rib width at joint to the top: 3.5 mm
Taper angle of rib: 0.5 degree
Number of ribs: 11 in the total at equal intervals in the longitudinal direction (involving those present on the two side boards)
6 in the total in the lateral direction (involving those present on the two side boards and those present on the lines 150 mm and 650 mm distant from the two side boards).

Table 1 illustrates total transmittances of the matrix resin and the fiber-reinforced resin. Table 2 illustrates the properties of the thus obtained concrete form measured at the top part.

EXAMPLES 3–5

A concrete form was produced by repeating Example 1, except that a propylene pellet (matrix resin; AX574, manufactured by Sumitomo Chemical Co., Ltd.; MI=45) containing a glass fiber having a fiber length of 0.1 mm or less and a fiber diameter of 10 μm was used.

Table 1 illustrates the total transmittances of the matrix resin and the fiber-reinforced resin, and Table 2 illustrates the properties of the thus obtained concrete form measured at the top part.

COMPARATIVE EXAMPLES 1 AND 2

A glass fiber mat (VHM5075, manufactured by Nippon Byleen Co.) was held between the up and dies and a melted matrix resin (AX574, manufactured by Sumitomo Chemical Co., Ltd.; MI=45) was fed thereto. Thereafter, the procedure of Example 1 was repeated to obtain a concrete form.

Table 1 illustrates the total transmittances of the matrix resin and the fiber-reinforced resin, and Table 2 illustrates the properties of the thus obtained concrete form measured at the top part.

COMPARATIVE EXAMPLES 3

A concrete form was produced by repeating Example 1, except that a propylene pellet (matrix resin; AX574, manufactured by Sumitomo Chemical Co., Ltd.; MI=45) containing a glass fiber having a fiber length of 0.1 mm or less and a fiber diameter of 10 μm was used.

Table 1 illustrates the total transmittances of the matrix resin and the fiber-reinforced resin, and Table 2 illustrates the properties of the thus obtained concrete form measured at the top part.

TABLE 1

| | Matrix resin | | Concrete form (Fiber-reinforced resin) | | |
|---|---|---|---|---|---|
| | Thickness (mm) | Total transmittance Tt(M) (%) | Fiber weight fraction α (% by wt.) | Thickness (mm) | Total transmittance Tt(C) (%) |
| Example 1 | 2.5 | 52.4 | 30.1 | 2.5 | 50.1 |
| Example 2 | 3.5 | 46.1 | 31.2 | 3.5 | 42.3 |
| Example 3 | 2.5 | 52.4 | 20.3 | 2.5 | 44.9 |
| Example 4 | 4.8 | 39.8 | 33.3 | 4.8 | 16.3 |
| Example 5 | 2.5 | 52.4 | 20.1 | 2.5 | 23.8 |
| Comparative Example 1 | 2.5 | 52.4 | 29.8 | 2.5 | 7.0 |
| Comparative Example 2 | 3.5 | 46.1 | 15.0 | 3.5 | 17.3 |
| Comparative Example 3 | 4.8 | 39.8 | 40.3 | 4.8 | 9.5 |

TABLE 2

| | Bending strength ($kg/cm^2$) | Bending modulus ($kg/cm^2$) | Impact strength | See-through property |
|---|---|---|---|---|
| Example 1 | 1,150 | 44,000 | ○ | ○ |
| Example 2 | 1,100 | 21,000 | ○ | ○ |
| Example 3 | 800 | 38,000 | Δ | ○ |
| Example 4 | 1,250 | 50,000 | ○ | ○ |
| Example 5 | 900 | 41,000 | Δ | ○ |
| Comparative Example 1 | 1,150 | 49,000 | ○ | x |
| Comparative Example 2 | 700 | 37,000 | ○ | x |
| Comparative Example 3 | 1,450 | 56,000 | ○ | x |

What is claimed is:

1. A concrete form including a top board having at least a portion thereof made from a fiber-reinforced thermoplastic resin, said fiber-reinforced thermoplastic resin satisfying the following conditions:

$$Tt(C) \geqq Tt(M) - 1.5\alpha$$

$$15 \leqq Tt(C)$$

wherein Tt(C) (%) is total transmittance of the fiber-reinforced thermoplastic resin measured at the thickness of the top board, $\alpha$ (% by weight) is fiber weight fraction of the fiber-reinforced thermoplastic resin, and Tt(M) (%) is a total transmittance of the matrix resin measured at the thickness of the top board.

2. A concrete form according to claim 1, wherein said matrix resin is polypropylene.

3. A concrete form according to claim 1 or 2, wherein the fiber used for loading is a glass fiber having a fiber length in a range from 0.1 mm to 50 mm.

4. A concrete form according to claim 1 or 2, wherein the fiber weight fraction $\alpha$ is in a range from 10% to 50% by weight.

5. A concrete form according to claim 3, wherein the fiber weight fraction $\alpha$ is in a range from 10% to 50% by weight.

6. A concrete form having at least a portion thereof made from a fiber-reinforced thermoplastic resin, including a matrix resin and reinforcement fibers, said fiber-reinforced resin satisfying the conditions:

$$Tt(C) \geqq Tt(M) - 1.5\alpha$$

$$15 \leqq Tt(c)$$

wherein Tt(C) is a percentage of total light transmittance through a thickness of the fiber-reinforced thermoplastic resin at a specified location, $\alpha$ is a fiber weight fraction of the fiber-reinforced thermoplastic resin, and Tt(M) is a percentage of total light transmittance of the matrix resin through the thickness at said specified location.

7. A concrete form according to claim 6, wherein said matrix resin is polypropylene.

8. A concrete form according to claim 6 or 7, wherein the fiber used for loading is a glass fiber having a fiber length in a range from 0.1 mm to 50 mm.

9. A concrete form according to claim 6 or 7, wherein the fiber weight fraction $\alpha$ is in a range from 10% to 50% by weight.

10. A concrete form according to claim 8, wherein the fiber weight fraction $\alpha$ is in a range from 10% to 50% by weight.

11. A concrete form comprising a substantially flat board with a specified thickness and a plurality of ribs extending from said board, said board being made from a fiber-reinforced thermoplastic resin including a matrix resin and reinforcement fibers, said fiber-reinforced resin satisfying the conditions:

$$Tt(C) \geqq Tt(M) - 1.5\alpha$$

$$15 \leqq Tt(c)$$

wherein Tt(C) is a percentage of total light transmittance through the specified thickness of said fiber-reinforced thermoplastic resin board, $\alpha$ is a fiber weight fraction of the fiber-reinforced thermoplastic resin board, and Tt(M) is a percentage of total light transmittance of the matrix resin through the specified thickness of said fiber-reinforced thermoplastic resin board.

12. A concrete form according to claim 11, wherein said matrix resin is polypropylene.

13. A concrete form according to claim 11 or 12, wherein the fiber used for loading is a glass fiber having a fiber length in a range from 0.1 mm to 50 mm.

14. A concrete form according to claim 11 or 12, wherein the fiber weight fraction $\alpha$ is in a range from 10% to 50% by weight.

15. A concrete form according to claim 13, wherein the fiber weight fraction $\alpha$ is in a range from 10% to 50% by weight.

16. A concrete form according to claim 13, wherein the fiber used for loading is a glass fiber having a fiber length in a range from 1 mm to 15 mm.

17. A concrete form according to claim 11, wherein the fiber used for loading is a glass fiber having a fiber diameter in a range from 1 to 50 $\mu$m.

18. A concrete form according to claim 11, wherein said specified thickness of said board is in a range from about 10 mm to 15 mm.

19. A concrete form according to claim 11, wherein said ribs are formed from said fiber-reinforced thermoplastic resin.

20. A concrete from according to claim 19, wherein said ribs are disposed in parallel to one another along said board and have a thickness in a range between about 62 mm to 65 mm.

* * * * *